US005370021A

United States Patent [19]

Shigematsu

[11] Patent Number: 5,370,021

[45] Date of Patent: Dec. 6, 1994

[54] POLYGON HEADED WRENCH

[75] Inventor: Mikio Shigematsu, Kashiwara, Japan

[73] Assignee: Eight Co., Ltd., Osaka, Japan

[21] Appl. No.: 60,919

[22] Filed: May 13, 1993

[51] Int. Cl.[5] ..... B25B 13/48

[52] U.S. Cl. ..... 81/436; 81/460

[58] Field of Search ..... 81/436, 460

[56] References Cited

U.S. PATENT DOCUMENTS 4,246,811 1/1981 Bondhus et al. .

4,338,835 7/1982 Simons ..... 81/436

*Primary Examiner*—James G. Smith

*Attorney, Agent, or Firm*—Armstrong, Westerman, Hattori, McLeland & Naughton

[57] ABSTRACT

A polygon headed wrench comprising a shank, a neck and a head, the head being provided with: flat surfaces extending in parallel to a central axis of the wrench; vertically aligned first tapered surfaces and vertically aligned second tapered surfaces, the first tapered surfaces and the second tapered surfaces gradually tapering the wrench head from its middle to extend in continuation to each flat surface toward the wrench central axis vertically and symmetrically with respect to an axis extending perpendicularly to the wrench central axis; and edge surfaces which extend from and in the same number as of the vertically lower second tapered surfaces of vertically aligned second tapered surfaces and converge into the wrench central axis, and a neck comprising third tapered surfaces which extend from and in the same number as the upper second tapered surfaces toward the central axis of the wrench and toward the shank.

2 Claims, 10 Drawing Sheets

POLYGON HEADED WRENCH

BACKGROUND OF THE INVENTION

1. Field of the Invention

The invention relates to a polygon headed wrench for use in tightening and releasing socket head bolts.

2. Description of the Prior Art

This kind of polygon headed wrench used hitherto is exemplified in FIG. 9. The polygon headed wrench comprises a shank 101, a neck 102 and a head 103 Formed integrally and coaxially with each other along the central axis 100. The head 103 has curved surfaces 104 in the same number as the corresponding surfaces of the shank 101, the center of curvature of the curved surfaces 104 being set on the central axis 100 and the surface of the neck 102 being curved inwardly.

The conventional polygon headed wrench may be used in a first manner of filling the head 103 into the hexagon socket head bolt 105 with the central axis of the wrench being aligned with the central axis 106 of the bolt 105, and in a second manner, as shown FIG. 10, with the central axis 100 being slanted in the extent of inclination $\alpha 1$ from the bolt central axis 106.

In either manner of use, the conventional wrench has merely smaller contact areas between the curved surfaces 104 of the head 103 and the inner surface the bolt 105. The curved surfaces 104 to contact with the bolt inner surface 107 are relatively easily worn due to repeated use of the wrench, so that the wrench will have relative slip between Lie curved surfaces 104 and the inner surface 107 and not produce Lightening torque and releasing torque. When the curved surfaces 104 are further worn, the wrench runs idle to be unusable. That is, the conventional polygon headed wrench has the problem of a brief span of life.

Another polygon headed wrench which has been proposed in Japanese Utility Model Publication No. Sho 60-19895 is exemplified in FIG. 11. The polygon headed wrench comprises a shank 201, a neck 202 and a head 203 formed integrally and coaxially with each other along the central axis 200. The head 203 has curved surfaces 204 in the same number as the corresponding surfaces of the shank 201, flat surfaces 205 extending in parallel to the central axis 200 and another fiat surfaces 206 extending slantwise with respect to the central axis 200. The center of curvature of the curved surfaces 204 are set at a point displaced from the central axis 200. The slanted flat surfaces 206 slant nearer the central axis 200 as extending to the neck 202, and the surfaces of the neck 202 slant further away from the central axis 200 as extending to the shank 201.

This polygon headed wrench does, similarly with the foregoing wrench shown in FIGS. 9 and 10, have merely smaller contact areas between the slanted flat surfaces 206 of the head 203 and the .inner surface of the hexagon socket head bolt 105. This is because even when such wrench is designed of the head 203 to allow the wrench to be usable with the central axis 200 being slanted at relatively large inclination (30°) with respect to the central axis 106 of the bolt 105, the wrench has only the slanted flat surfaces 206 between the flat surfaces 205 and the neck 202. When the head 203 is otherwise designed to allow the wrench to be usable with the central axis 200 being slanted at inclination $\alpha^2$ (15°) with respect to the bolt central axis 106 as shown in FIG. 12, the curved surfaces 204 and the slanted flat surfaces 206 become largely different from each other in their contact areas with the inner surface 107 of the hexagon socket head bolt 105. Such unbalance of the contact areas leads to larger wear of the curved surfaces 204 having smaller contact areas, resulting in a short life of the polygon headed wrench. That is, the polygon headed wrench proposed in the Japanese reference has the same problem of a brief span of life as of the foregoing conventional wrench shown FIGS. 9 and 10.

SUMMARY OF THE INVENTION

The present invention has been designed to overcome the above problems created in the conventional polygon headed wrench.

An object of the present invention is to provide a polygon headed wrench which when used with its central axis being slanted with respect to the central axis the corresponding socket head bolt can have larger contact areas between the head of wrench and the corresponding inner surface of the boll head. The polygon headed wrench also avoids occurrence unbalance between specific contact areas to have improved resistance to wear, thereby enabling to keep for long the tightening and releasing the socket head bolt with larger torque.

Another object of the present invention is to provide a polygon headed wrench which when used with varied inclination of its central axis with respect to the central axis of socket head boll can keep larger contact areas therewith to have improved resistance to wear.

A polygon headed wrench according to a principal invention for achieving the aforesaid objects is a polygon headed wrench comprising a shank, a neck and a head formed integrally and coaxially with each other along a central axis of the polygon headed wrench, the head part of the polygon headed wrench being provided with:

a plurality of flat surfaces extending in parallel to the central axis of the wrench;

a plurality of vertically aligned first tapered surfaces and a plurality of vertically aligned second tapered surfaces, the first tapered surfaces and the second tapered surfaces are provided by gradually tapering the wrench head from its middle to extend in continuation to each fiat surface toward the wrench central axis and formed vertically or symmetrically with respect to a transverse axis extending perpendicularly to the wrench central axis through centers of the flat surfaces in their extension along the wrench central axis; and edge surfaces which extend from and in the same number as of the vertically lower second tapered surfaces of the plurality of vertically aligned second tapered surfaces and converge into the wrench central axis.

According to the polygon headed wrench constructed as above, in such a use manner of the wrench that the head is fit into a socket head bolt with the central axis of the wrench being aligned with that of the socket head bolt, all of the plurality of flat: surfaces are brought into contact with the inner surface of the bolt head. Also, in another use manner that the head is fit in the bolt with the wrench central axis being slanted at maximum inclination with respect to the bolt central axis, selected ones among the plurality of vertically aligned second tapered surfaces are brought into contact with the inner surface of the bolt head. In a third use manner that the head is fit in the bolt with the wrench central axis being slanted at smaller inclination with respect to the bolt central axis, selected ones among the plurality of vertically aligned first tapered surfaces are brought into contact with the bolt head inner surface.

Hence, the present invention provides larger contact areas between the wrench head and the corresponding bolt to improve resistance to wear at the wrench head, thereby achieving a long life of wrench with its longer duration of service.

Another polygon headed wrench according to the present invention is so constructed on the basis of the principal invention that the extension of the surfaces along the wrench central axis is set to values obtainable by the formula $2\times\sqrt{(B/2)^2-(A/2)^2}$ (wherein A is an interval between opposite flat surfaces, and B is an interval between opposite inner surfaces of the socket head bolt) and that of the first tapered surfaces to those by the formula $\sqrt{\{(B/2)-(A\times\cos\beta/2)\}^2+(A\times\sin\beta/2)^2}$ (wherein $\beta$ is $\alpha-\gamma$, $\alpha$ is maximum inclination of the polygon headed wrench, and $\gamma$ is inclination of a slanted line connecting an intersection between the wrench central axis and the transverse axis with the flat surface at one end of its extension along the wrench central axis with respect to the transverse axis), and slant angles of the second tapered surfaces are set to the same value as of maximum inclination of the wrench central axis, and further extension of the second tapered surfaces, which located near the edge surfaces, along the wrench central axis is set to have such a maximum value that when the polygon headed wrench is fit into a corresponding socket head bolt with the wrench central axis being slanted at maximum inclination with respect to a central axis of the bolt, those second tapered surfaces near the edge surfaces do not contact at their lower ends with the bottom of inner surface of the socket head bolt and the second tapered surfaces near the neck of wrench may be abutted against the inner surface of the socket head bolt.

According to the polygon headed wrench constructed as above, use of the wrench with its central axis being slanted at maximum inclination with respect to a central axis of a corresponding socket head bolt may be enabled by the feature that selected ones among the plurality of vertically aligned second tapered surfaces can be brought into contact with the inner surface of the bolt head. Also, use of the wrench with its central axis being slanted at smaller inclination than the maximum with respect to a central axis of the corresponding socket head bolt may be enabled by the feature that selected ones among the plurality of vertically aligned first tapered surfaces can be brought into contact with the inner surface of the bolt head.

DETAILED DESCRIPTION OF THE PREFERRED EMBODIMENT

Figure 1:
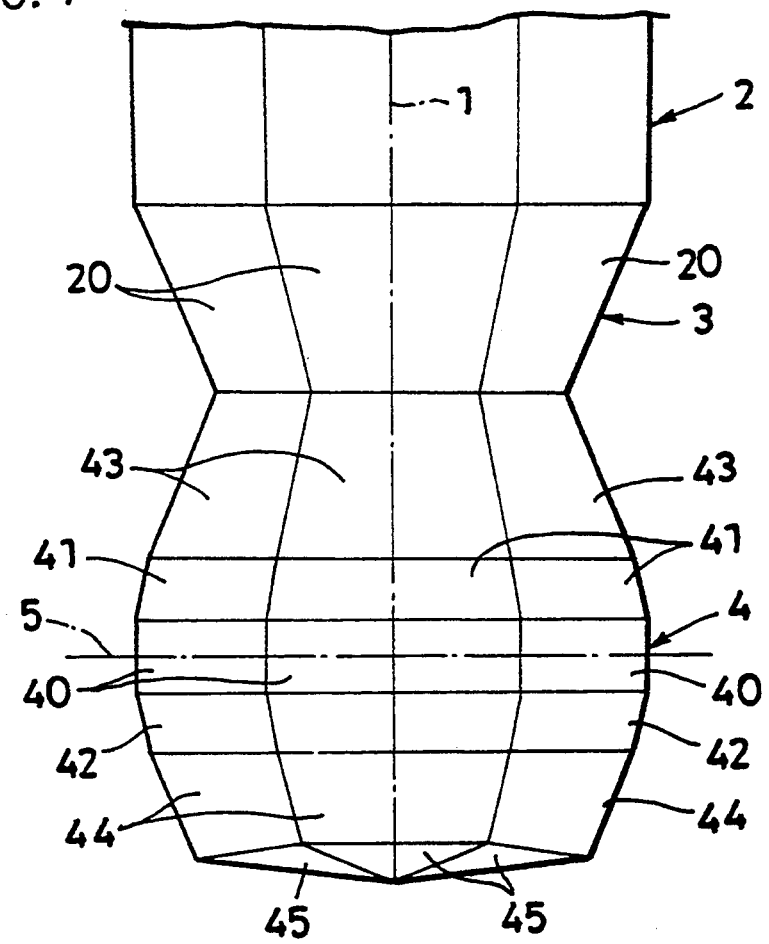
FIG. 1 is a front view showing an example of a polygon headed wrench according to the present invention.
Figure 2:
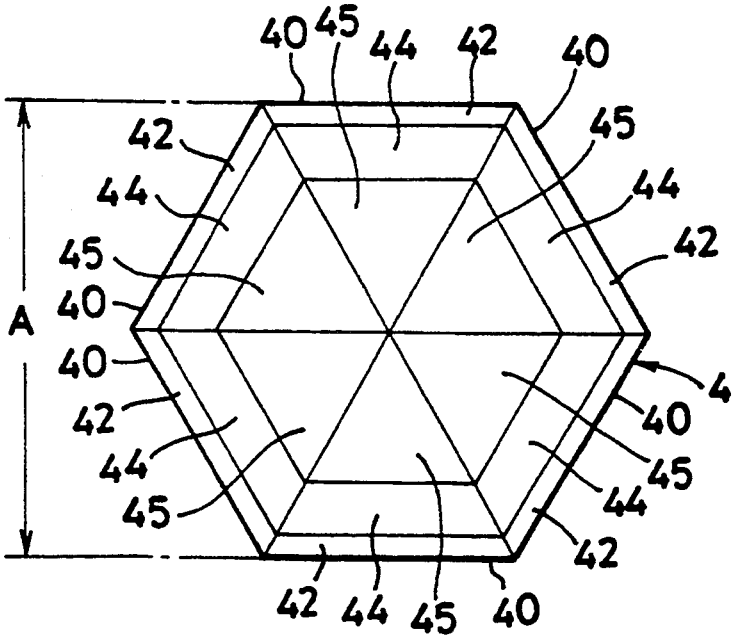
FIG. 2 is a bottom view of the same.

The polygon headed wrench shown in FIGS. 1 and 2 comprises a shank 2, a neck 3 and a head 4 formed integrally and coaxially with each other along the central axis 1 and has a cross-section of regular hexagon.

The head 4 is provided with flat surfaces 40 which are in the same number as that of the surfaces of the shank 2, extend in parallel to the central axis 1 of the wrench; vertically aligned first tapered surfaces 41, 42 and are at the vertical edges, respectively, of flat surfaces 40 vertically aligned second tapered surfaces 43, 44, are at the vertical edges, respectively, of tapered surfaces 41, 42, such the first and second tapered surfaces being in the same number, the first tapered surfaces 41, 42 in and the second tapered surfaces 43, 44, respectively, gradually tapering the wrench head 4 from its middle to extend in continuation to each flat surface 40 toward the wrench central axis 1 and, depending upon the angle and direction of tilt of the wrench relative to the socket head bolt being tightened or loosened form couples vertically and symmetrically with respect to a transverse axis 5 extending perpendicularly to the wrench central axis 1 through centers of the flat surfaces 40 in their extension along the wrench central axis 1; and edge surfaces 45 which extend from and in the same number as of the vertically lower second tapered surfaces 44 of vertically aligned second tapered surfaces 43, 44 and converge into the wrench central axis 1. The neck 3 comprises third tapered surfaces 20 which extend from and in the same number as of the upper second tapered surfaces 43 to the shank 2 in such manner of being further away from the central axis 1 as extending to the shank 2.

Extension of the flat surfaces 40, first tapered surfaces 41, 42 and second tapered surfaces 43, 44 along the central axis 1 corelates to the available inclination of the central axis 1 of the wrench in use. Also, the polygon headed wrench (FIG. 1) may be usable in such manner that the head is fit in a hexagon socket head bolt 6 shown in FIG. 3 with the central axis 1 being aligned with the central axis 7 of the bolt 6, and also in another manner with the central axis 1 being slanted with respect to the bolt central axis 7. In either use, the wrench is required to be minutely and precisely designed in sizes of specific parts of the head in order to have possible largest contact area sections to be contacted with the inner surface 8 of the bolt 6.

Figure 3:
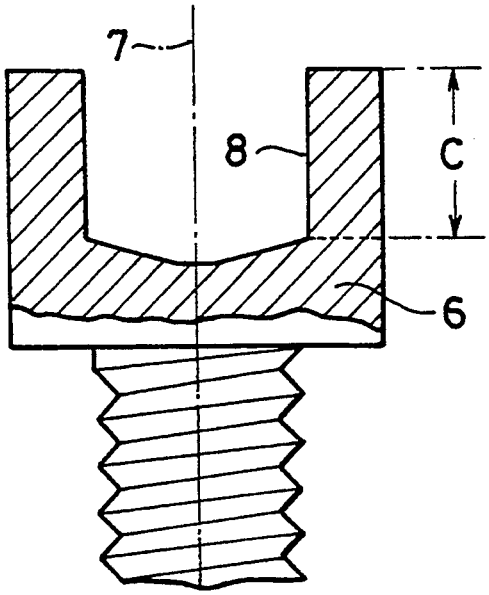
FIG. 3 is a sectional view showing a corresponding socket head bolt to the polygon headed wrench according to the present invention.
Figure 4:
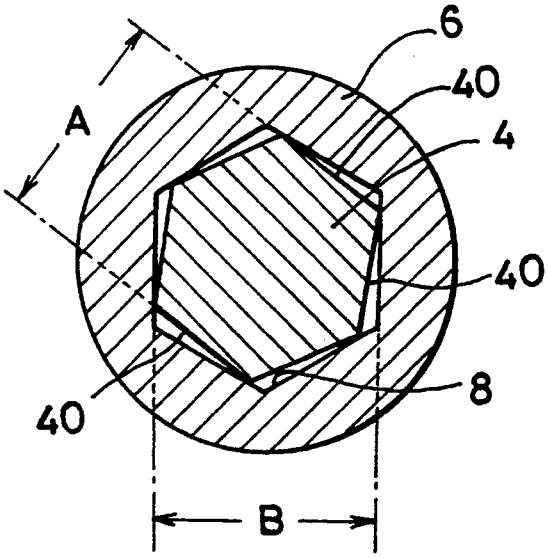
FIG. 4 is a cross section of the wrench head fit and turned in the corresponding bolt head.
Figure 5:
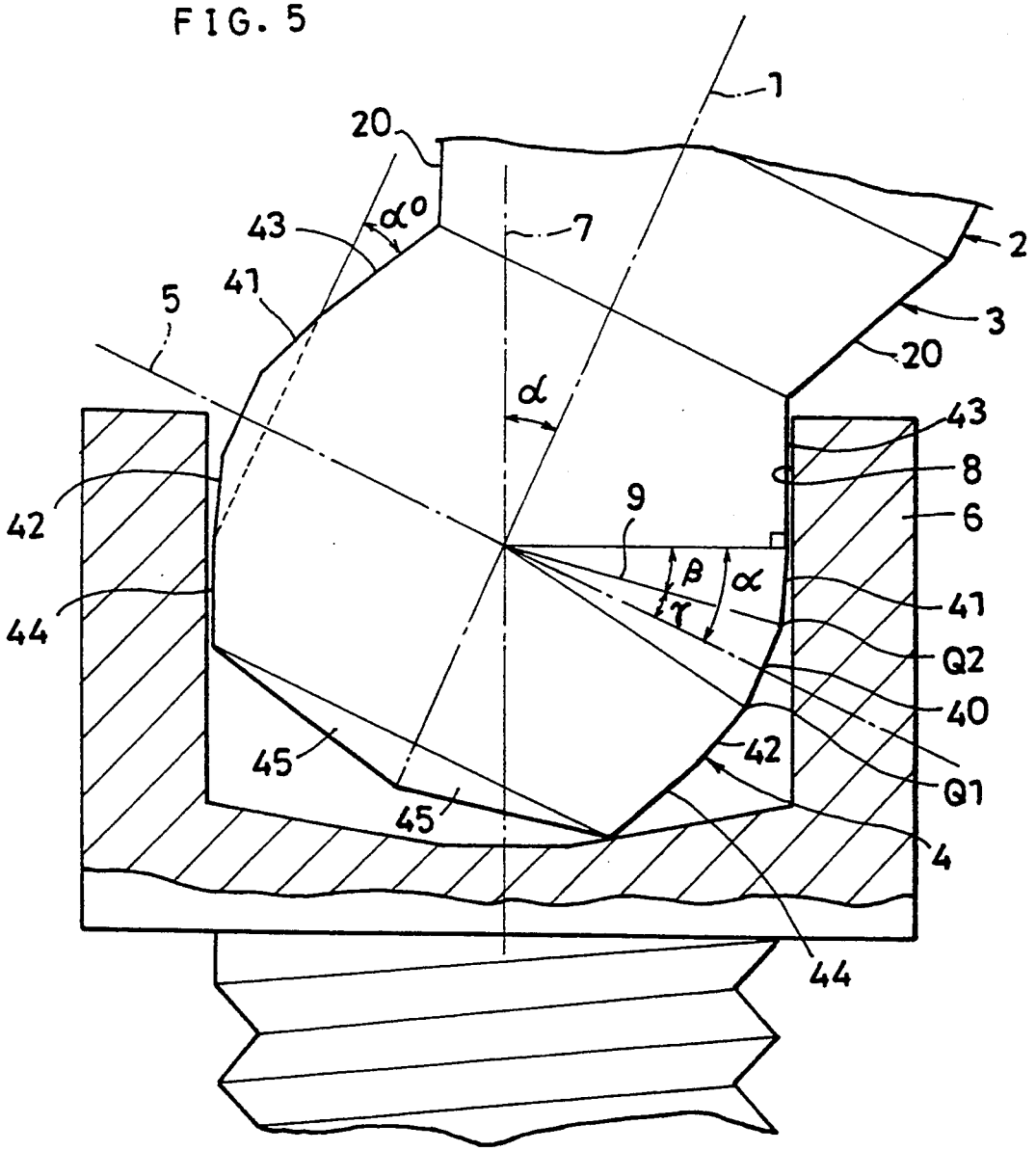
FIG. 5 is a sectional view showing a relationship between the inside of bolt head and the wrench head.

Minimum values of the intervals B between opposite inner surfaces 8 and the depths C of the inner surfaces of the hexagon socket head bolt 6 shown in FIGS. 3 and 4 are defined by JIS. Relationship among the intervals B between the opposite inner surfaces 8 and the depth C of the inner surface 8, the intervals A between opposite flat surfaces 40 at the head 4 and maximum inclination $\alpha$ of the wrench central axis 1 with respect to the central axis 7 of the bolt 6 will be detailed with referring to FIG. 5.

The extension of the flat surfaces 40 along the central axis 1 (called hereunder the "extension") is desirable to be as large as possible in order to improve the properties of resistance to wear. However, when the "extension" of the flat surfaces 40 is made too larger, the wrench in use will be restrained from being slanted due to abutment of both ends Q1, Q2 of the flat surfaces 40 in the direction of its "extension" against the bolt inner surface 8 before the central axis 1 is slanted at maximum inclination $\alpha$. Hence, the "extension" of the flat surface 40 is subject to limitation in design accordingly, and is set, within the limited range, to values based on maximum values defined by the formula $2\times\sqrt{(B/2^2-(A/2)^2}$.

Also, the "extension" of the first tapered surfaces 41, 42 is desirable to be as large as possible in order Lo improve the properties of resistance to wear. However, when the "extension" of the first tapered surfaces 41, 42 is made too larger, the wrench in use will be restrained from being slanted due to abutment of both ends of the first tapered surfaces 41, 42 in the direction of their "extension" against, the bolt inner surface 8 before the central axis 1 is slanted at maximum inclination $\alpha$. Hence, the "extension" of the first tapered surfaces 41, 42 is, accordingly, subject to limitation in design, and is set, within the limited range, to values based on maximum values defined by the formula $\sqrt{\{(B/2)-(A\times\cos\beta/2)\}^2+(A\times\sin\beta/2)^2}$.

$\beta$ is $\alpha-\gamma$, and $\gamma$ is inclination of a slanted line 9 connecting an intersection 0 between the wrench central axis 1 and the transverse axis 5 with the flat surface 40 at one end Q2 in its "extension" with respect to the transverse axis 5.

Setting the "extension" of the first tapered surfaces 41, 42 based on the above formula determines slant angles of the first tapered surface 41, 42 with respect to the wrench central axis 1.

Maximum slant angles a 0 of the second tapered surfaces 43, 44 with respect to the wrench central axis 1 is set to values equal to the maximum inclination $\alpha$ of the central axis 1. That is, since the maximum slant angles $\alpha 0$ of the second tapered surfaces 43, 44 are slightly larger than that of the first tapered surfaces 41, 42, the first and second tapered surfaces 41, 42 and 43, 44 are arranged in series to gradually become nearer the central axis 1.

"Extension" of the second tapered surfaces 44 near the edge surfaces 45 is set to have a maximum value corresponding to such a value determined based on the depth C of the hexagon socket head bolt, i.e. that when the polygon headed wrench is fit into the corresponding socket head bolt 6 with the wrench central axis 1 being slanted at maximum inclination $\alpha$ with respect to the central axis 7 of the bolt 6, those second tapered surfaces 44, near the edge surfaces 45, do not contact, at their lower ends, with the bottom of inner surface of the socket head bolt 6 and the second tapered surfaces 43, near the neck of wrench, may be abutted against the inner surface 8 of the socket head bolt 6. Also, "extension" of the second tapered surfaces 43, to be abutted against the bolt inner surface 8 when the polygon headed wrench is slanted the maximum inclination $\alpha$ is set, to a value substantially equal to the "extension" of the second tapered surfaces 44 near the edge surfaces 45. The border between the second tapered surfaces 44 and the edge surfaces 45 may be chamfered for facilitation of fitting into the hexagon socket head bolt.

Sizes of the fiat surfaces 40, first tapered surfaces 41, 42 and second tapered surfaces 43, 44 on the head 4, with maximum inclination $\alpha$ of the wrench central axis 1 being about 30° corresponding to hexagon socket head bolt 6 in JIS·M12 (B is 10.04—10.13 mm and C is 6 mm or more) are: A 10.0 mm, "extension" of the flat surfaces 40 about 0.9 mm, that of first tapered surfaces 41, 42 about 1.9 mm, that of second tapered surfaces 43 about 2.5 mm, and that of second tapered surfaces 44 about 2.0 mm.

Figure 6:
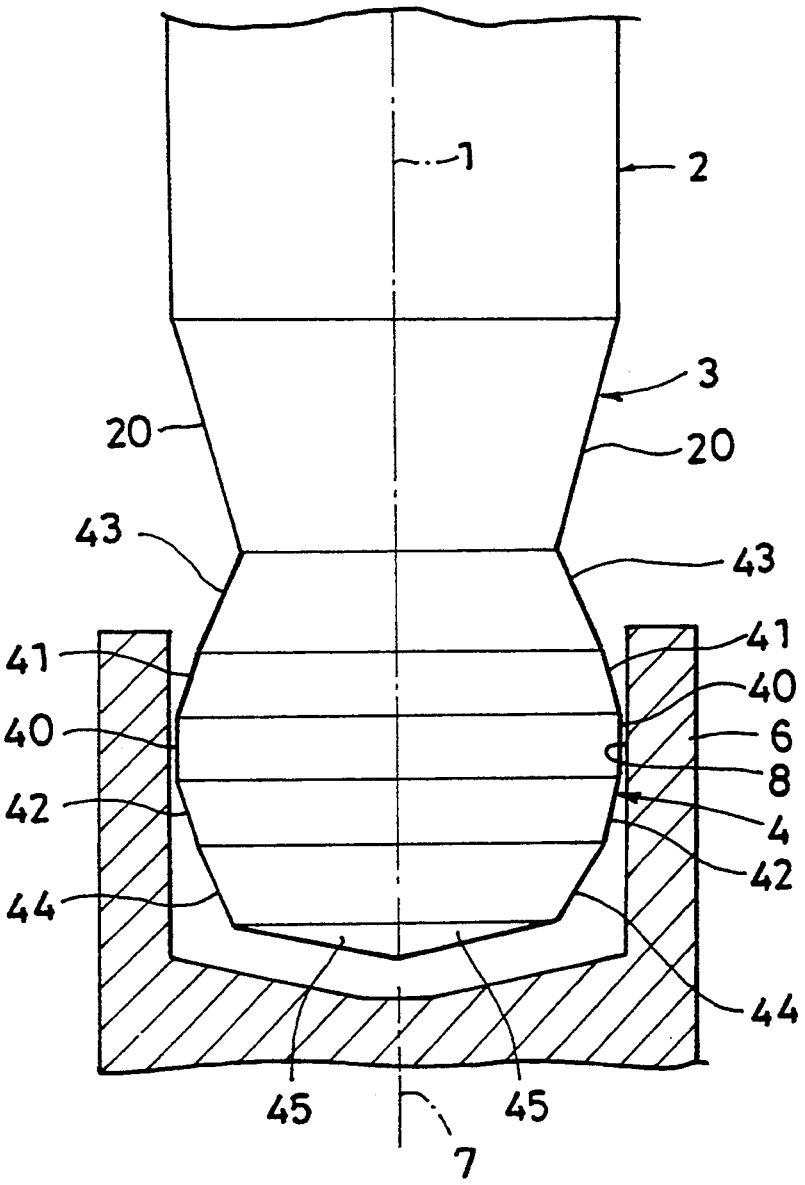
FIG. 6 is a sectional view showing an example of the polygon headed wrench in use.
Figure 7:
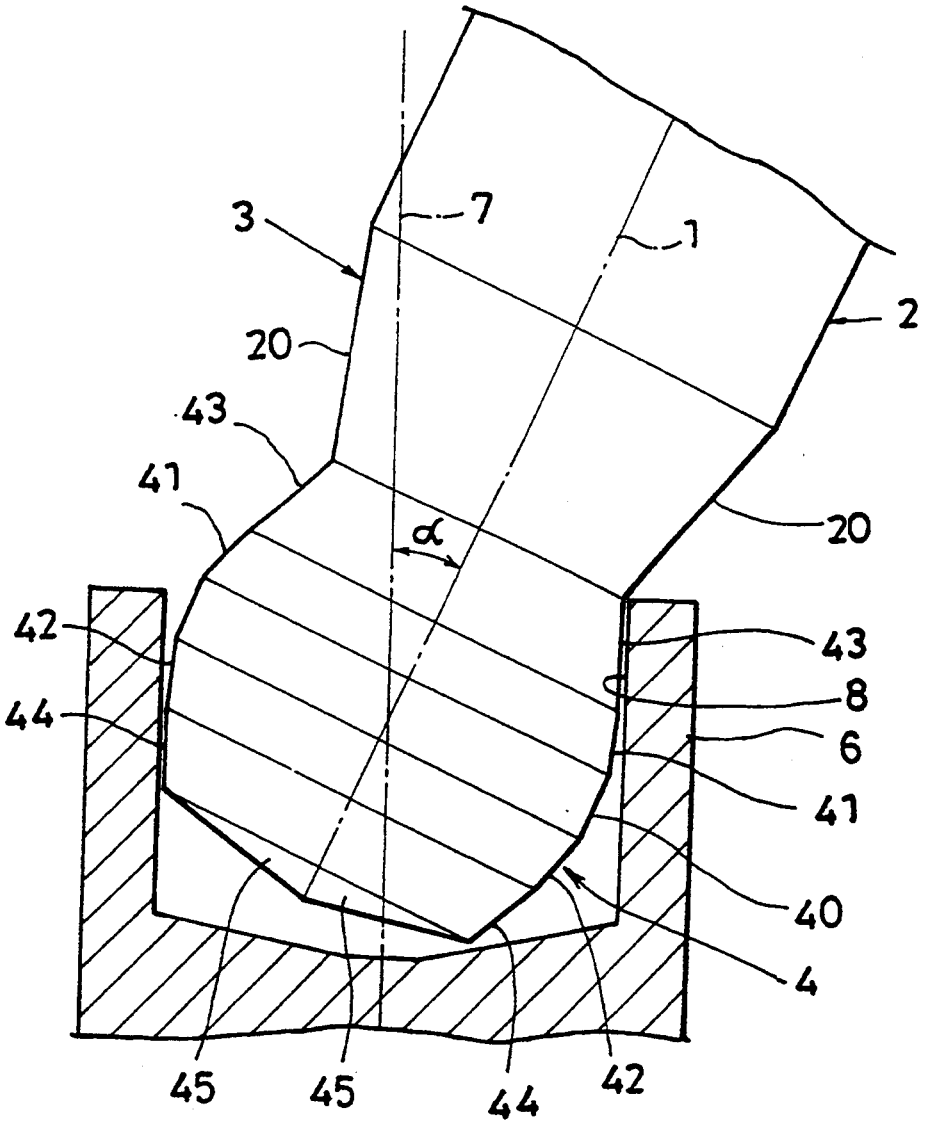
FIG. 7 is a sectional view showing another example of the polygon headed wrench in use.
Figure 8:
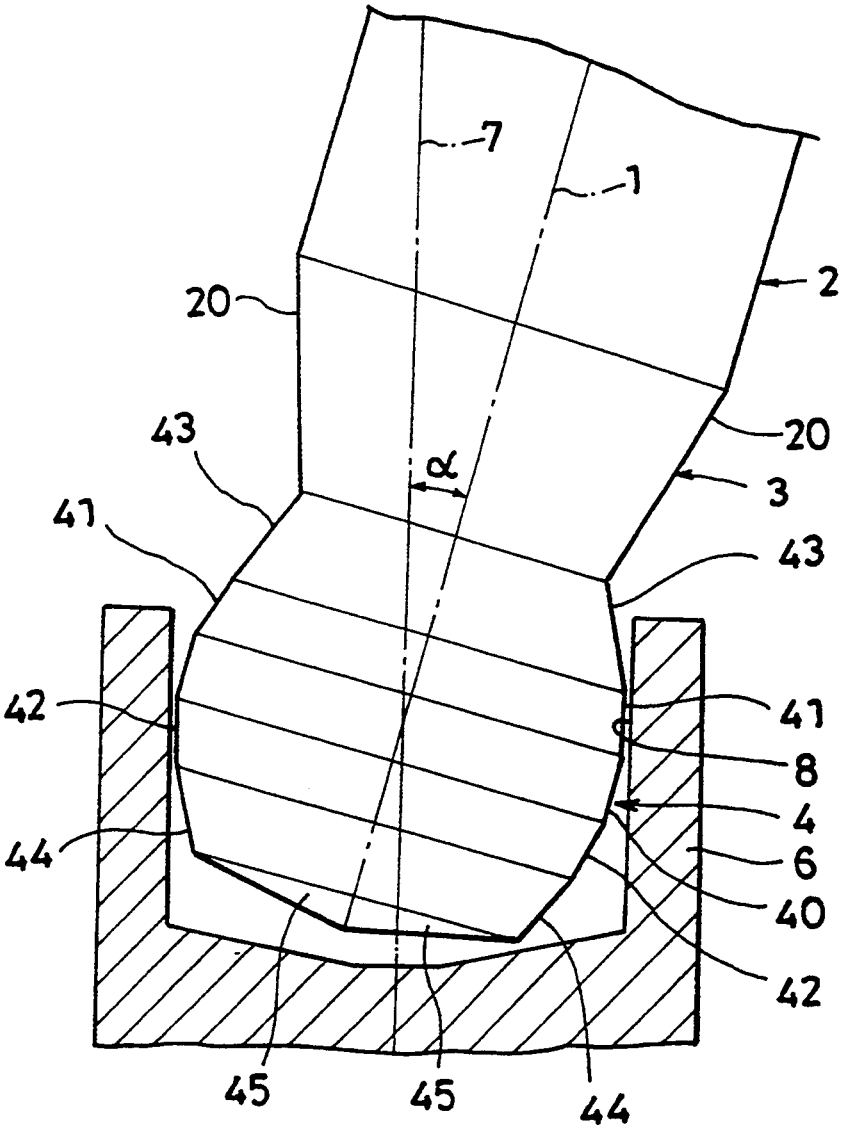
FIG. 8 is a sectional view showing a further modified example of the polygon headed wrench in use.
Figure 9:
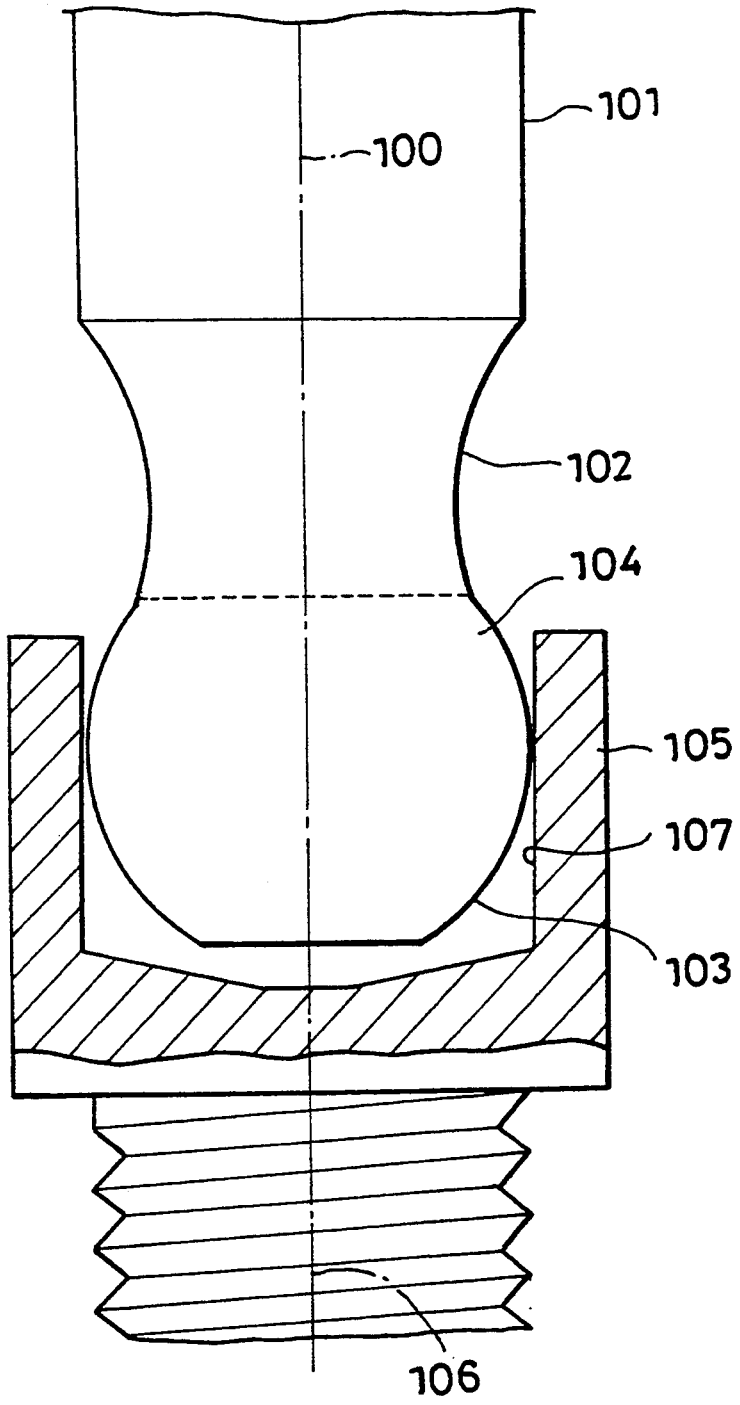
FIG. 9 PRIOR ART
FIG. 9 is a sectional view showing a conventional polygon headed wrench in use.
Figure 10:
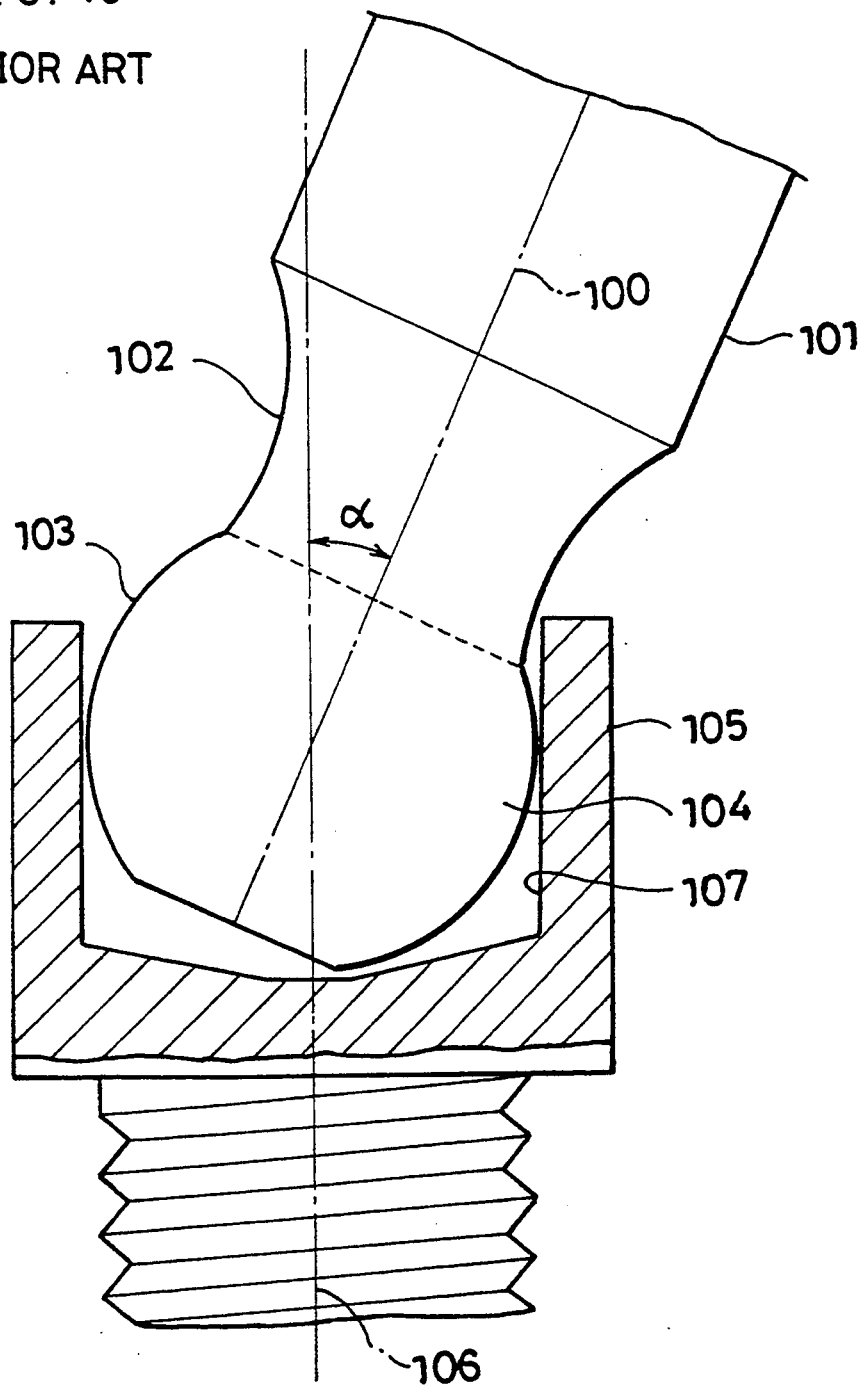
FIG. 10 PRIOR ART
FIG. 10 is a sectional view showing another use of the wrench shown in FIG. 9.
Figure 11:
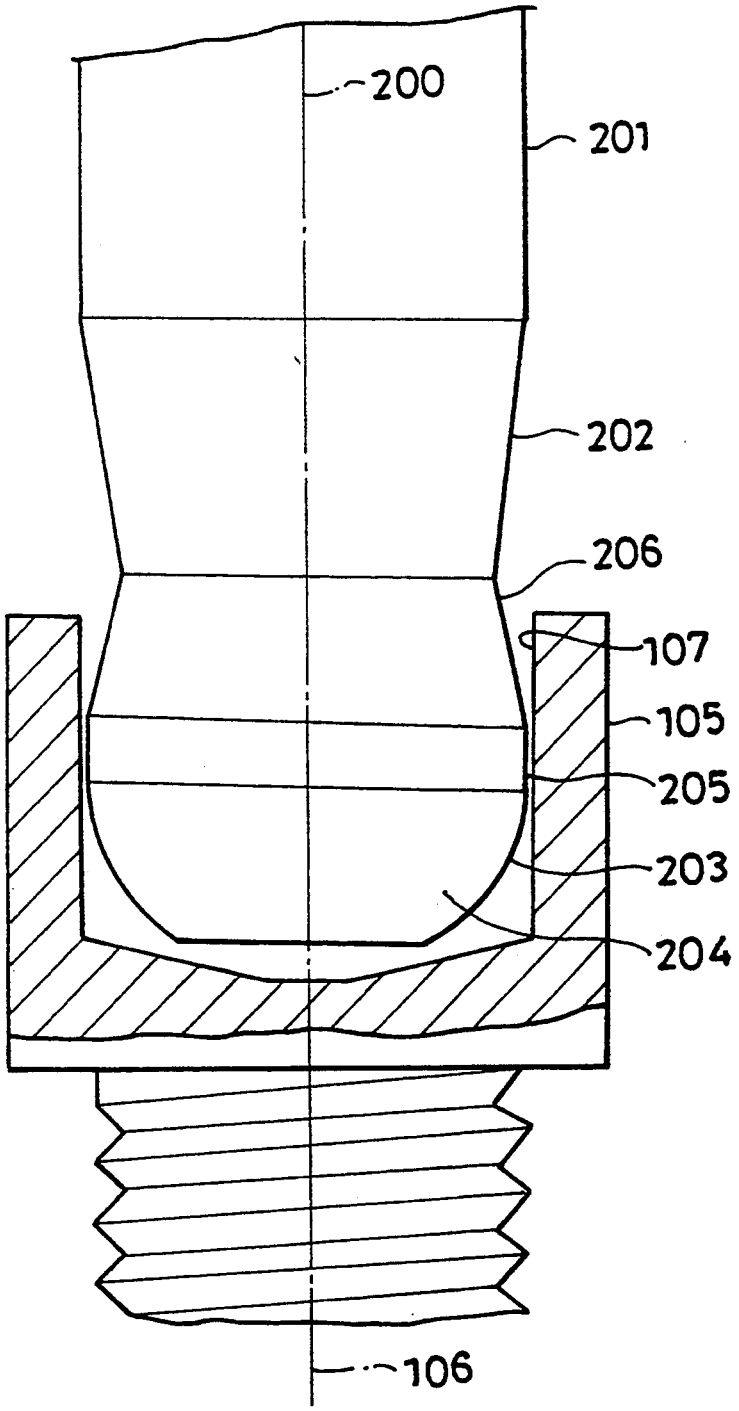
FIG. 11 PRIOR ART
FIG. 11 is a sectional view showing another conventional polygon headed wrench in use.
Figure 12:
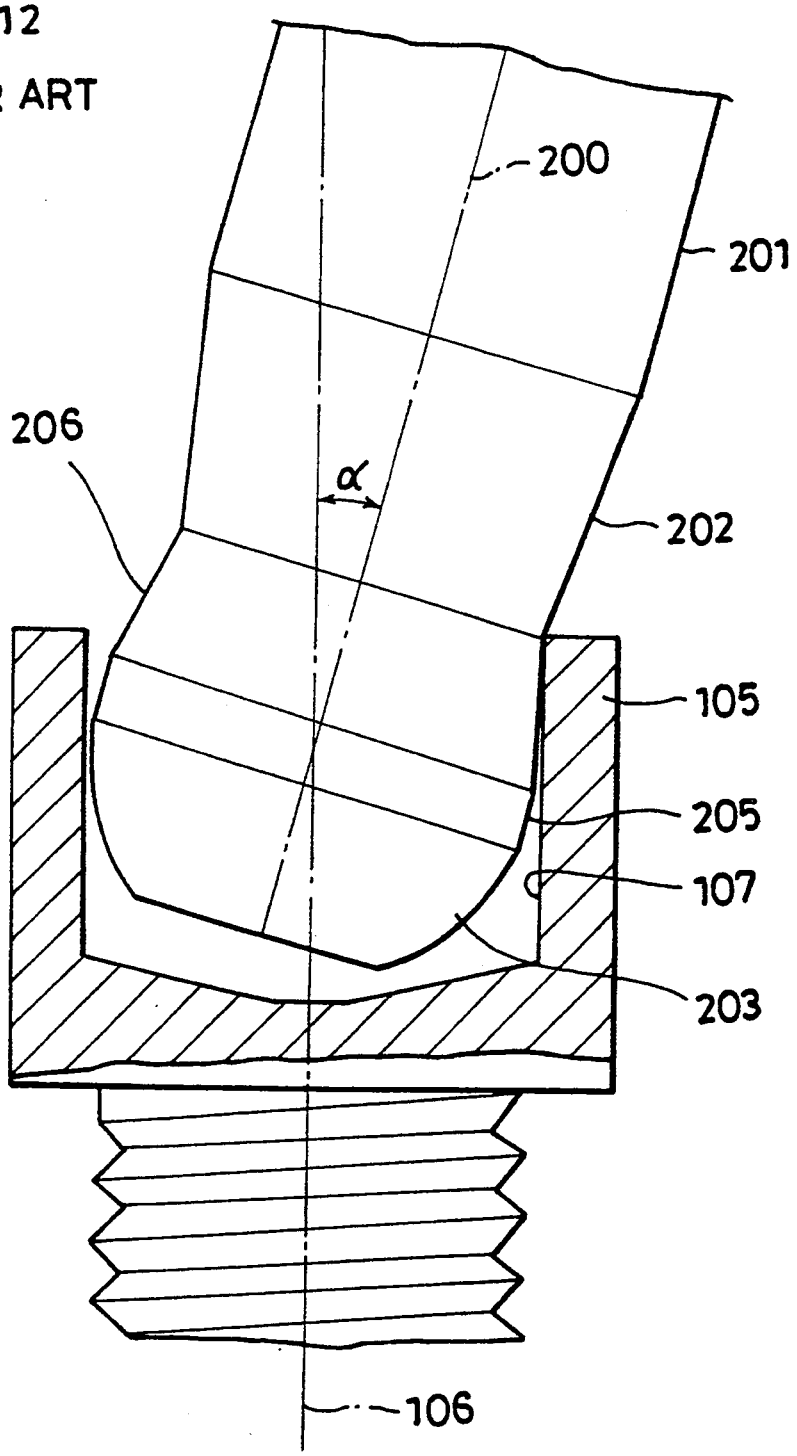
FIG. 12 PRIOR ART
FIG. 12 is a sectional view showing another use of the wrench shown in FIG. 11.

Next, use of the polygon headed wrench will be detailed. FIG. 6 shows a use manner wherein the head 4 of the polygon headed wrench is fit in the hexagon socket head boll 6 with the central axis 1 of the wrench being aligned with the central axis 7 of the bolt 6. In this case, the shank 2 is turned around the central axis 1 to cause six fiat surfaces 40 on the head 4 to be brought into contact with the inner surface 8 of the hexagon head bolt, thereby providing larger contact areas. FIG. 7 shows another use manner in which the wrench central axis 1 is slanted at maximum inclination $\alpha$ (about 25°) with respect to the bolt central axis 7. In this case, the shank 2 is turned around the central axis 1 to allow three second tapered surfaces 43 and three second tapered surfaces 44 on the head 4 opposite to such tapered surfaces 43 to be brought into contact with the bolt inner surface 8, thereby providing larger contact areas. Furthermore, FIG. 8 shows a third use manner in which the wrench central axis 1 is slanted at inclination $\alpha$ (about 15°) with respect to the bolt central axis 7. In this case, the shank 2 is turned around the central axis 1 to allow three first tapered surfaces 41 and three first tapered surfaces 42 on the head 4 opposite to such tapered surface 41 to be brought into contact with the bolt inner surface 8, thereby providing larger contact areas. In detail, whether the central axis 1 of the polygon headed wrench, in turn, the head 4 in use is aligned with the central axis 7 of the corresponding hexagon socket, head bolt: 6 or slanted with respect to the central axis 7, larger contact areas of the head 4 with the inner surface 8 of the bolt 6 can be ensured. Also, occurrence of unbalance of usable contact areas on the specific parts of the head 4 can tie avoided to improve resistance to wear, whereby tightening and releasing the socket head bolt with larger torque car, be kept long.

The above example has referred to the hexagon headed wrench, but the present invention may be applicable also to triangle, rectangle, pentagon or any other polygon headed wrench. Also, the neck 3 may be round in cross-section.

What is claimed is:

1. A polygon headed wrench comprising a shank, a neck and a head formed integrally and coaxially with each other along a central axis of the polygon headed wrench, characterized in that the head part of the polygon headed wrench is provided with:

a plurality of flat surfaces extending in parallel to the central axis of the wrench;

a plurality of vertically aligned first tapered surfaces and a plurality of vertically aligned second tapered surfaces, said first tapered surfaces extending axially of said wrench from the vertical opposite edges, respectively, of said flat surfaces and said second tapered surfaces extending axially of said wrench from the vertical opposite edges, respectively, of said first tapered surfaces, said first and second tapered surfaces, gradually tapering said wrench head from its middle to extend in continuation to each flat surface toward the wrench central axis and vertically and symmetrically with respect to a transverse axis extending perpendicularly to said wrench central axis and through centers of said flat surfaces relative to said wrench central axis; and edge surfaces extending from and in the same number as said second tapered surfaces of said second tapered surfaces and converge into said wrench central axis.

2. A polygon headed wrench as set forth in claim 1, wherein and extension of said flat surfaces along said wrench central axis is set to values obtainable by the formula $2\times\sqrt{(B/2)^2-(A/2)^2}$ and that of the first tapered surfaces to the formula $\sqrt{\{(B/2)-(A\times\cos\beta/2)\}^2+(A\times\sin\beta/2)^2}$, and slant angles of said second tapered surfaces are set to the same value as of maximum inclination of the wrench central axis, and extension of said second tapered surfaces, located near the edge surfaces along said wrench central axis have a maximum value that when the polygon headed wrench is fit into a corresponding socket head bolt with the wrench central axis slanted at maximum inclination with respect to a central axis of the bolt, said second tapered surfaces, near the edge surfaces, do not contact at their lower ends with the bottom of inner surface of the socket head bolt and said second tapered surfaces near the neck of said wrench abut against the inner surface of said socket head bolt.

* * * * *